United States Patent [19]

Pietreniak et al.

[11] 4,127,637

[45] Nov. 28, 1978

[54] METHOD OF MANUFACTURING A DRY-FORMED, EMBOSSED ADHESIVELY BONDED, NONWOVEN FIBROUS SHEET

[75] Inventors: Eugene J. Pietreniak, Newark, Del.; Joseph Stankavage, Chester, Pa.

[73] Assignee: Scott Paper Co., Philadelphia, Pa.

[21] Appl. No.: 558,054

[22] Filed: Mar. 13, 1975

[51] Int. Cl.[2] ..... D04H 1/64

[52] U.S. Cl. ..... 264/114; 28/103; 156/209; 156/219; 264/91; 264/128; 428/152; 428/171

[58] Field of Search ..... 428/152, 153, 171, 198, 428/361, 154; 156/209, 219, 291, 290, 183, 277, 62.6; 162/112, 184, 231, 135, 111; 264/257, 282, 283, 284, 293, 294, 324

[56] References Cited

U.S. PATENT DOCUMENTS

| | | | |
|---|---|---|---|
| 3,083,128 | 3/1963 | Herriaton et al. | 156/219 |
| 3,301,746 | 6/1967 | Sanford et al. | 162/113 |
| 3,377,224 | 4/1968 | Gresham et al. | 162/112 |
| 3,395,201 | 7/1968 | Kalwairtes | 264/45 |
| 3,523,536 | 8/1970 | Ruffo | 428/151 |
| 3,616,157 | 10/1971 | Smith | 428/171 |
| 3,764,451 | 10/1973 | Dunning | 264/119 |
| 3,776,807 | 12/1973 | Dunning et al. | 156/62.2 |
| 3,817,827 | 6/1974 | Benz | 162/113 |
| 3,863,296 | 2/1975 | Buell | 264/91 |
| 3,903,342 | 9/1975 | Roberts, Jr. | 428/152 |
| 3,939,532 | 2/1976 | Wiegand | 264/91 |

FOREIGN PATENT DOCUMENTS 1,071,191 6/1967 United Kingdom.

*Primary Examiner*—Stanley S. Silverman
*Attorney, Agent, or Firm*—Martin L. Faigus; William J. Foley

[57] ABSTRACT

This invention relates to a unique method of fabricating a dry-formed, adhesively bonded nonwoven sheet and to the sheet formed thereby. The method of this invention includes the steps of forming a low integrity, dry-formed fibrous web having a basis weight in the range of from about 30 grams per square meter to about 170 grams per square meter; embossing the web to provide spaced-apart densified regions and high loft regions with the densified regions covering from about 15% to about 40% of the planar area of the web and having a density greater than about 0.150 grams per cubic centimeter, and with the high loft regions having a density of less than about 0.100 grams per cubic centimeter; stabilizing the embossed pattern with a binder for retaining a differential density within the embossed web as it is directed to a creping surface and creping the embossed web by adhering it to a creping surface under conditions which do not destroy the differential density in the embossed web and employing a creping doctor blade which foreshortens the web as it removes it from the creping surface for forming a creped, aesthetically pleasing nonwoven sheet of this invention in which the surface appearance resulting from the creping operation is controlled by the embossed pattern.

7 Claims, 5 Drawing Figures

METHOD OF MANUFACTURING A DRY-FORMED, EMBOSSED ADHESIVELY BONDED, NONWOVEN FIBROUS SHEET

BACKGROUND OF THE INVENTION

1. Field of the Invention

This invention relates generally to soft, flexible, dry-formed fibrous sheets having an aesthetically pleasing appearance for use in many applications for which conventional textile fabrics have been employed in the past, and to a unique method for manufacturing such sheets. More specifically, this invention relates to dry-formed, adhesively bonded nonwoven fibrous sheets which are embossed, bonded and creped in a manner to achieve sufficient strength properties to permit their use for applications in which conventional textile fabrics have been employed in the past, and in addition to possess a high degree of bulk and aesthetic appeal which enhances their suitability for replacing such conventional textile fabrics.

2. Description of the Prior Art

Dry-formed, nonwoven sheets have become popular, especially for single and limited use applications, to replace higher cost textile fabrics formed by conventional textile operations, such as weaving and knitting. Obviously, it is highly desirable to form nonwoven sheets in a manner which will impart properties to them that are similar to those possessed by conventional textile fabrics which said sheets are intended to replace. Specifically, such nonwoven sheets should be formed in a manner to impart sufficient strength, bulk, flexibility, extensibility and softness thereto so that the nonwoven sheet will approximate the "hand" and appearance of such textile fabrics.

Nonwoven sheets have already been accepted as replacements for conventional textile fabrics for many end uses. For example, absorbent nonwoven fibrous sheets are commonly employed today as replacements for conventional textile fabrics for household and industrial wipers, as well as for cover sheets in sanitary napkins and disposable diapers.

Dry-formed nonwoven fibrous sheets have been manufactured by a wide variety of processes. In forming such nonwoven sheets considerable attention has been directed to imparting to the sheets both physical and aesthetic properties which are similar to the physical and aesthetic properties of the textile fabrics which said sheets are intended to replace. Properties such as porosity and/or absorbency are highly desirable in nonwoven fibrous sheets which are employed in products such as household wipers, industrial wipers and cover sheets for sanitary napkins and disposable diapers. However, it is well known that for the general replacement of textile fabrics, the most critical properties which nonwoven sheets must possess are softness and an aesthetic appearance approximating such textile fabrics.

The prior art has suggested many methods for enhancing the softness of dry-formed nonwoven sheets. These methods have included, in part, the judicious selection of specific elastomeric binders to bond the fibers in the web together; the application of binders in specific spaced-apart patterns and various post-treatment operations, such as embossing and creping.

Creping is one of the most commonly employed techniques for enhancing the softness of a fibrous web; the prior art relating to creping being quite extensive. Known creping techniques include the conventional blade creping of a fibrous sheet from a creping surface, as well as compacting techniques employing flexible belts, rolls provided with flexible coverings and combinations of such rolls and belts. These methods have all been designed to deform the fibrous sheet, by compaction, in a manner to work the fibers in the sheet for enhancing softness.

Several techniques are also known for enhancing the appearance, or texture, of nonwoven sheets so that the sheets will approximate the appearance of conventional textile fabrics which they are intended to replace. One technique which has been commonly employed for this purpose is to include apertures or holes in the web, and this approach has been disclosed in many patents. In addition, the prior art discloses a number of techniques for creping, or consolidating a nonwoven sheet to achieve a texture that is more textile-like than the familiar cross-ridged configuration of conventional creped sanitary paper products, such as facial tissue, toilet tissue and the like.

British Pat. No. 1,294,794, assigned to Scott Paper Company, discloses controlling the crepe pattern in a nonwoven web containing predominantly short cellulosic fibers of a papermaking length less than about 6 millimeters by adhering the web to a creping surface through a spaced-apart pattern of a binder which is applied to the web prior to or at the same time as adhering said web to the creping surface. The web is adhered to the creping surface either solely, or most tenaciously in the web regions occupied by the binder, and the specific binder pattern functions to control, or regulate the overall appearance, or crepe pattern, in the completely formed nonwoven sheet.

U.S. Pat. No. 3,665,921, relates to the mechanical working of a nonwoven fibrous web, and is one of a related family of patents owned by Kimberly-Clark. This patent discloses a consolidating operation in which the web is bonded by a thermoplastic adhesive in a spaced-apart pattern, and then is consolidated by being removed from a creping drum by a consolidating blade to coalesce the spaced-apart adhesive pattern to produce a looped fiber structure.

U.S. Pat. No. 3,301,746, issued to Sanford et al., teaches the adherence of a thermally predried paper web to a creping surface by pressing the web against the surface with a high-knuckle carrier fabric; the knuckle pattern influencing the crepe pattern resulting from the removal of the web from the creping surface by a creping doctor blade.

U.S. Pat. No. 3,059,313, issued to Harmon, discloses the post treatment of a fibrous web which has a binder applied to it in a discrete, spaced-apart pattern. This web is post-treated by crimping the fabric between opposed elastic roll surfaces to deform the web into an undulating configuration which is controlled by the spaced-apart binder segments. Specifically, the binder segments are disposed in side walls of the undulations intermediate the peaks of said undulations.

Other methods have been proposed for controlling the behavior of a fibrous web as it is creped from a creping surface. For example, it has been suggested to crepe a fibrous web from a creping surface with a serrated creping doctor blade to achieve a ribbed appearance in the web.

Many of the above-discussed prior art processes are limited in their ability to either affect a uniform softening of a nonwoven sheet, or to achieve a wide variety of different appearances, or textures in such a sheet. For example, there are definite limitations as to the manner in which a binder can be applied to a nonwoven web in order to impart the requisite strength to the completed sheet. The most severe limitation is dictated by the particular fiber composition of the web, since the adhesive should be applied in a manner to stabilize the fibers to a degree sufficient to permit the use of the sheet as a replacement for a conventional textile fabric. Accordingly, when a spaced-apart binder pattern is employed to control the configuration of a web resulting from a creping or compacting operation, the particular appearances which can be achieved are limited by the particular fiber composition of the web, since the fiber composition dictates the particular bond spacing which can be tolerated.

When a serrated doctor blade is employed to control the configuration of a nonwoven web in a creping operation, regions of the web which are aligned with the serrations in the doctor blade will not experience the same high degree of softening as the web regions which are directly contacted by other regions of the doctor blade. Accordingly, uniformity in softness is not always achieved by this method of creping and the appearance is limited to stripes.

When the appearance of a web is controlled by applying a differential pressure to different regions of a web by a highknuckle fabric to adhere said web to a creping surface for subsequent creping, the pattern, or appearance of the creped web is influenced by the particular knuckle pattern in the fabric. Generally, the configuration of the knuckle pattern is limited by the particular mesh of the fabric which is required to support said web so that it will not become damaged by being trapped within the interstices between elements of said fabric. Accordingly, the control over the final appearance of the web is limited, at least in part, by the particular spacing which can be tolerated between the elements of the fabric.

SUMMARY OF THE INVENTION

This invention resides in a unique method for controlling the creping of a dry-formed, adhesively bonded nonwoven web in a manner which produces unique nonwoven sheets which are soft, and which may possess any one of a number of different textures approximating the textures of a wide variety of conventional textile fabrics manufactured by conventional textile operations, e.g., weaving and knitting.

The method of this invention is markedly different from the prior art methods previously discussed. Specifically, the instant invention relates to controlling the behavior of a dry-formed web, at the point of creping, by the particular embossed pattern formed in the web prior to creping. Applicants have found that embossing of the web, within certain limitations to be hereinafter disclosed, causes the densified areas and the high loft areas to behave differently during a creping operation to actually affect the crepe pattern, at least on the surface of the web adhered to the creping drum. The embossed pattern controls the general surface appearance of the web independently of the manner in which the web is adhered to a creping surface; provided that the process is carried out in a manner which does not destroy the differential density in the embossed web.

The method of the instant invention includes the steps of initially dry-forming a high loft, low integrity web; embossing the web in a manner so as to form a pattern of loft areas and dense areas; including a bonding means to stabilize the embossed pattern in the web so that a differential density in the web is retained during subsequent processing and creping the web by adhering it to a creping surface and foreshortening the web by removing it from the creping surface with a creping doctor blade.

The web required for use in the method of this invention can be formed by any well known dry-forming technique which provides a web having a basis weight of from about 30 grams per square meter to about 170 grams per square meter, and having an initial web density of less than about 0.100 grams per cubic centimeter. The web can be made from various blends of fibers; ranging from 100% short cellulosic fibers of a papermaking length less than about 6 millimeters (e.g., wood pulp and cotton linters) to 100% textile-length fibers having an average length greater than about 6 millimeters, and generally up to about 75 millimeters. Most preferably, the textile fibers have a length of up to about 35 millimeters. Suitable long fibers for use in the method of this invention are any of the natural or synthetic fibers suitable for use in textile manufacturing operations. The choice of fibers and the blend thereof will be governed by such factors as cost, availability and the strength required to be imparted to the sheet produced by the method of this invention.

The embossing step required by this invention involves compressing a portion of the web to a density of at least 0.150 grams per cubic centimeter, while leaving other portions of the web substantially uncompressed, i.e., having a density of less than about 0.100 grams per cubic centimeter. The compressed areas should be disposed over the planar extent of the web and occupy from between about 15% and about 40% of the planar area of said web; the choice of pattern of compressed areas being governed by the appearance and texture desired in the final nonwoven sheet.

It is essential to this invention that the embossed pattern be stabilized by a binder means for retaining a differential density in the web during the subsequent steps in the method of this invention. The preferred method for retaining the embossed pattern in the web is to employ a permanent, preferably elastomeric, binder which is dried and set immediately after the embossing step. This method of stabilizing an embossed web is disclosed in U.S. patent application Ser. No. 279,691, filed Aug. 10, 1972, and assigned to Scott Paper Company. That application is incorporated by reference into the instant application, and is a division of abandoned parent application Ser. No. 23,751, filed Mar. 30, 1970.

The creping step is required to be performed in a manner which does not significantly reduce the density differential which is stabilized in the web prior to creping. Accordingly, compaction techniques in which a web is passed through a nip defined by elastomeric rolls, belts, or a combination of rolls and belts are not preferred for use in the method of this invention since these methods tend to excessively compress the web during the compaction operation.

The preferred method of creping the web of this invention is by adhering the embossed web to a surface of a creping drum, the creping the web off of the drum by a creping doctor blade. This method of creping the embossed web can be carried out by employing a print-crepe assembly similar to that described in British Pat. No. 1,294,794 (FIG. 2) in which the embossed web is directed first through a print-bonding nip to apply a binder to said web, and then said web is pressed by a pressure roll against a creping surface to adhere the web, through the binder, to said creping surface. The web is subsequently removed from the creping surface by a creping doctor blade.

When a permanent binder is applied to the web prior to the creping step to retain the density differential in said web, a temporary binder, such as starch, dextrin, polyvinyl alcohol, or the like, can be employed to adhere the web to the creping surface. These temporary binders form brittle bonds which are not replied upon to provide additional strength to the nonwoven sheet after the creping operation. However, if desired, a second permanent binder can be employed to adhere the embossed web to the creping surface. These permanent binders generally form most elastic bonds than those formed by a temporary binder, and have the capability of retaining the fibers in the web in a bonded condition after the creping operation to impart additional strength to the nonwoven sheet.

In contrast with most of the prior art relating to controlling the crepe pattern in a paper or nonwoven web, the process of the instant invention is relatively insensitive to the binder pattern printed onto the sheet in the print-crepe operation. Thus, the choice of binders and print patterns is relatively independent of the desired texture whiich is to be formed in the web, and therefore can be optimized to meet the desired softness and strength parameters required in the completed nonwoven sheet.

The nonwoven sheet of this invention, formed according to the method of this invention, is generally characterized by a high degree of flexibility, elongation and bulk, all of which contribute to a very pleasant hand or softness; and a surface appearance or texture which can be varied over a wide range of textile-like configurations by varying the embossing pattern imparted to the dry-formed web during the embossing operation.

Applicants have found that when a permanent binder is applied dried and set prior to the creping step, to retain the embossed pattern in the web, the creped sheet will retain a significant portion of the pattern originally embossed into it. Thus, a three-dimensional pattern very similar to the original embossed pattern will be retained in the creped, nonwoven sheet of this invention. This sheet will be considerably softer after creping, and the compressed areas will show a much coarser crepe-ridge pattern running transversely to the machine direction of the sheet than a crepe pattern disposed in the loft areas. In fact, in some creping operations the loft areas will not contain any crepe pattern at all.

Other objects and advantages of this invention will become apparent upon reading the detailed description which follows, taken in conjunction with the drawings.

DESCRIPTION OF THE PREFERRED EMBODIMENT OF THE INVENTION

At the outset, it should be clearly understood that the method of the present invention may be employed to fabricate a wide variety of dry-formed sheets. For example, the dry-formed sheets can range in basis weight from about 30 grams per square meter to about 170 grams per square meter. Also, the sheets can include various percentages of short cellulosic fibers of a papermaking length less than about 6 millimeters, and staple-length fibers over 6 millimeters in length. The dry-formed webs employed in this invention can be formed by air-laying, carding, garnetting and similar dry-forming techniques.

The description which follows will be directed to a preferred embodiment of this invention in which the nonwoven sheet of this invention is formed by employing an air-laid web including a blend of randomly arranged and intermingled short cellulosic fibers of a papermaking length less than about 6 millimeters and longer reinforcing fibers of a staple-length greater than about 6 millimeters, and generally up to about 35 millimeters. Preferably, the web includes, by fiber weight, over 50% short cellulosic fibers, and most preferably from about 75% to about 90% short cellulosic fibers.

Figure 1:
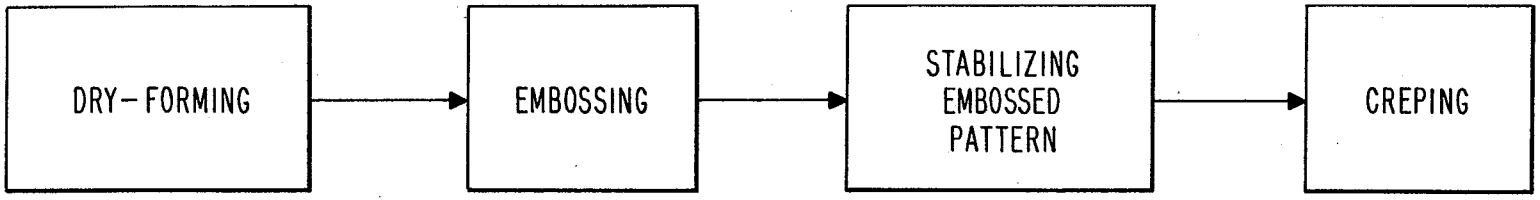
FIG. 1 is a flow chart showing a preferred method for forming a nonwoven sheet according to this invention.

Referring to the flow chart depicted in FIG. 1, a preferred method of this invention includes the steps of dry-forming a low integrity web having a basis weight of from about 30 grams per square meter to about 170 grams per square meter; embossing the web to provide densified areas and high loft areas, said densified areas being disposed over substantially the entire planar extent of the web in a spaced-apart pattern covering from about 15% to about 40% of the planar area of said web and having a density of at least about 0.150 grams per cubic centimeter and most preferably, at least about 0.200 grams per cubic centimeter, said high loft regions being substantially uncompressed and having a density of no more than about 0.100 grams per cubic centimeter; stabilizing the embossed pattern by including a binder in the web; and creping the embossed web by adhering it to a creping surface and foreshortening said web by removing it from the creping surface with a creping doctor blade.

The method for calculating the density of the high loft and densified areas will now be described. An embossed web specimen of a given area, prior to creping, is weighed on an analytical balance. The sample is then sectioned by cutting the specimen through high-loft areas and dense areas. The cut edge is positioned parallel to the plane of a camera lens, and is photographed at a five times (5x) enlargement using a 42 mm (Leitz) macro lens. The image is recorded on Polaroid film (300 speed). The resultant image is measured in the densified and loft areas using a millimeter scale, and the recorded measurement corrected to actual size. The density of the high loft areas and densified areas are then calculated by the following formula:

$$\frac{\text{(Weight of Specimen (grams))}}{\text{(Area of Specimen (cm}^2\text{))} \times \text{(Thickness of area for which density is being calculated (cm))}}$$

For purpose of this calculation, it is assumed that the weight of fibers in the initally formed web is substantially the same in all areas, and this is believed to be a sufficiently accurate approximation for purposes of this invention.

Most preferably, the dry-forming step is achieved by any conventional air-laying process. A preferred process and apparatus for forming an air-laid web is disclosed in U.S. Pat. No. 3,862,472, issued on Jan. 28, 1975, and assigned to Scott Paper Company. This patent is incorporated by reference into the instant application.

The embossing operation can be carried out according to many well-known techniques. For example, the embossing operation can be performed by passing the initially formed, low integrity web through a nip defined by opposed rolls, each roll having a relief pattern engraved into its outer surface. If desired, these patterns can be matched so that opposed land areas will be in alignment in the embossing nip. This manner of embossing an air-laid web is disclosed in U.S. patent application Ser. No. 279,691, filed Aug. 10, 1972, and assigned to Scott Paper Company. This latter application has already been incorporated by reference into the instant application.

An alternative technique for embossing the nonwoven web is to pass it through a nip defined by a smooth surfaced roll and a roll containing a relief pattern engraved therein. In accordance with this method, the pattern will be most pronounced on the side of the web which is engaged by the engraved roll; however, the pattern will also be visible, at least to a minor extent, on the surface of the web engaged by the smooth surfaced roll.

If desired, or necessary, the moisture level of the initially formed web can be adjusted by spraying one or both surfaces thereof with water prior to the embossing operation. In some instances, the moisture level must be increased in order for the initially embossed pattern to be retained in the web. Details relating to adjusting the moisture level are disclosed in the prior art; including U.S. patent application Ser. No. 279,691, which has been incorporated by reference into this application. Specifically, it is contemplated that the moisture level in the initially formed web can be increased to a total of approximately 35% by weight, based on the air-dry weight of said initially formed web.

It is essential to this invention that there be some binder means for stabilizing the embossed configuration in the web for retaining a density differential in said web during the processing steps subsequent to embossing. The inclusion of a binder in the web can be achieved by many different methods. For example, opposed surfaces of the web can be sprayed with the binder, or the web can be passed through a nip of a gravure printing station to apply the binder to said web.

In accordance with one method of this invention, a binder which is capable of forming permanent bonds in the creped, nonwoven sheet of this invention is sprayed onto opposed surfaces of the embossed web in accordance with the teachings of U.S. application Ser. No. 279,169: (1) to interconnect the surface fibers of the web for stabilizing substantially all of said surface fibers; (2) to form adhesive networks extending completely through the web in the compressed regions thereof and (3) to form bonded regions which partially penetrate through said web in the high loft regions while leaving interior portions of said high loft regions unbonded. In accordance with this method, the adhesive preferably is a latex dispersion, and most preferably a self-cross-linkable acrylic latex dispersion, and is applied to the web so that the solids weight will constitute from about 5% to about 30% of the air-dry fiber weight in the web. Other similar binders can be employed in this invention; such binders being characterized by their ability to establish permanent bonds between fibers in the nonwoven sheet of this invention, even if the nonwoven web is creped after the binder has been set.

After the binder has been applied to the web said binder is set to retain a differential density in the embossed web.

Figure 2:
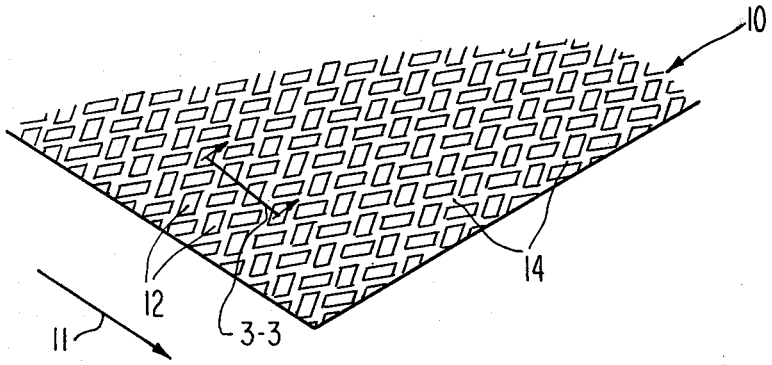
FIG. 2 is a plan view of an embossed nonwoven web prior to the creping thereof.
Figure 3:
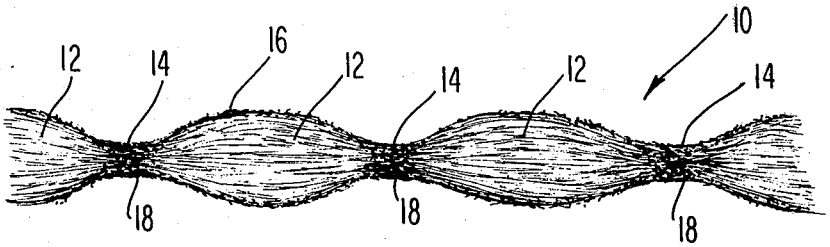
FIG. 3 is a sectional view along 3—3 of FIG. 2.

A representative embossed and bonded web 10 which is formed at this stage of the operation is shown in FIGS. 2 and 3 with arrow 11 showing the machine-direction of formation. This web is an air-laid web comprising from about 75% to about 90% by weight, short cellulosic fibers less than about 6 millimeters in length; the remaining fibers being longer reinforcing fibers over 6 millimeters in length. The web includes a plurality of high-loft areas 12 and compressed, densified areas 14, and the densified areas 14 constitute approximately 25% of the surface area of the web. The binder for stabilizing the embossed pattern in the web was applied by sequentially spraying each surface of the web while establishing a partial vacuum from the side of the web opposite that being sprayed; the binder distribution including a surface layer 16 which incompletely penetrates the high-loft areas 12, and a through-bonded network 18 which completely penetrates through the web in the compressed areas 14 to enhance the peel and tensile strengths of said web.

Figure 4:
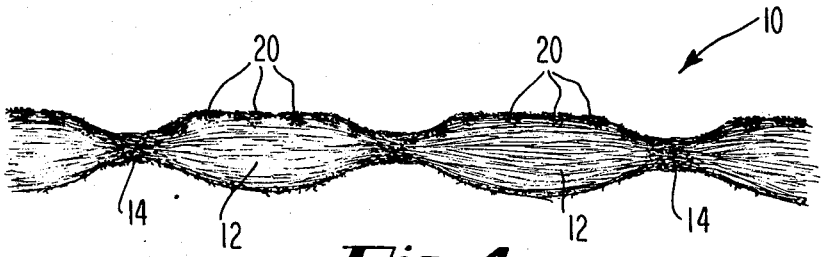
FIG. 4 is a sectional view similar to FIG. 3, but showing the web after a second adhesive has been applied to a surface thereof for use in adhering the web to a creping surface.

After the web 10 is formed, it is subjected to a creping operation. Referring to FIG. 4, the creping operation preferably is carried out by a print-crepe assembly at which additional binder 20 is applied to at least one surface of the embossed web 10, and the web 10 is adhered to a creping surface through said additional binder. One preferred method of applying the additional binder is to pass the web 10 through a printing nip formed by a backing roll and a gravure-type printing roll. The printing roll contains a pattern of binder receiving cells therein for transmitting binder from a pan into engagement with a surface of the web.

When a latex dispersion, or other permanent binder, is employed to retain the embossed pattern in the web, the additional binder can be a temporary binder, such as starch, dextrin or the like. These temporary binders are generally characterized by their capability of producing brittle bonds between fibers, which bonds are broken when the web is foreshortened by its removal from a creping surface by a creping doctor blade. If desired, the additional binder can be a permanent binder which forms bonds that are not broken by the creping operation.

Figure 5:
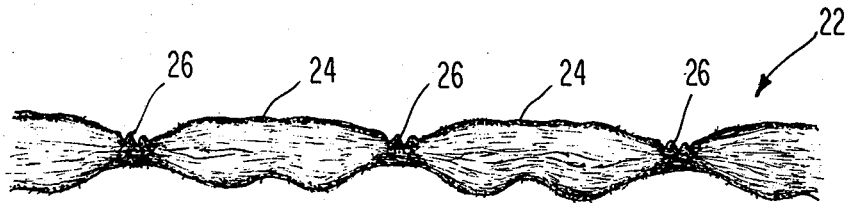
FIG. 5 is a sectional view similar to FIG. 3, but showing the configuration of the creped, nonwoven sheet of this invention.

Referring to FIG. 5, a creped nonwoven sheet 22 formed in accordance with the method of this invention is shown. In the embodiment shown the embossed pattern in the web is retained by a permanent binder sprayed onto both major surfaces, and the additional binder 20 is a permanent binder which is applied in a spaced-apart pattern onto one surface of said web, as shown in FIG. 4. The surfaces associated with the high-loft areas 12 contain a fine crepe pattern 24 therein, and adjacent surfaces associated with the compressed areas 14 include a buckled configuration 26 which is coarser than said fine crepe pattern. Also, the creping tends to remove at least a portion of the embossed pattern; however, the embossed pattern is, in most instances, clearly visible in the completed sheet 22 of this invention.

The surface of the web opposite the creped surface has a somewhat cross-ridged configuration which may, in some instances, be controlled by the embossed pattern in the web.

From the above description it can be seen that this invention employs the embossing of a high-loft air-laid web prior to a creping step in order to control the behavior of the sheet at the point of creping. It has been discovered that the embossing of a high-loft web so as to achieve a plurality of compressed regions having a density of at least 0.150 grams per cubic centimeter and covering from about 15% to about 40% of the surface area of the web can produce a much broader spectrum of textile-like textures and appearances than the prior art techniques for controlling textures.

In the preferred embodiment of this invention, a fine crepe pattern 24 will be associated with creped surfaces associated with the high-loft areas 12, and a coarser, undulating pattern 26 will be associated with creped surfaces associated with the compressed areas 14. However, in some cases the creped surfaces associated with the high-loft regions 12 will be substantially free of any crepe pattern, and the surfaces associated with the compressed areas 14 will include a fine crepe pattern. In all cases, the structure of the creped surface can be characterized as having a coarser crepe pattern on the surfaces associated with the compressed areas than on the surfaces associated with the high-loft areas. Accordingly, unless specified to the contrary, reference to the surfaces of the compressed areas having a coarser crepe pattern than surfaces of the high-loft areas is intended to also include the configuration in which the surfaces of the high-loft areas 14 are free of a crepe pattern.

Although, in the preferred embodiment of this invention, the binder employed to adhere to embossed web to the creping surface is applied by a print bonding operation, it is within the scope of this invention to include other means of applying said binder. For example, the additional binder can be applied by spraying or other similar operations.

Having described this invention, we claim:

1. In a method of forming a nonwoven fibrous sheet suitable for use as a replacement for conventional textile fabrics, said method comprising the sequential steps of:

(a) dry-forming a fibrous web having a basis weight of from about 30 grams per square meter to about 170 grams per square meter and having a density of less than about 0.100 grams per cubic centimeter;

(b) embossing the dry-formed web in a manner for providing spaced-apart densified areas and high loft areas over the planar extent of the web, said densified areas covering from about 15% to about 40% of the planar area of the web and having a density greater than about 0.150 grams per cubic centimeter; said high loft regions having a density of less than about 0.100 grams per cubic centimeter, said embossing forming an embossed pattern and providing a differential density in said web;

(c) stabilizing the embossed pattern by including a binder in the embossed web for retaining the differential density within the embossed web during subsequent process steps; and (d) creping the embossed web by adhering a surface of the embossed web to a creping surface, after the embossed pattern has been stabilized, and foreshortening the web by removing it from the creping surface with a creping doctor blade.

2. The method according to claim 1, wherein step (c) is performed by including a permanent binder in the web and setting said permanent binder for maintaining the integrity of the fibrous web after creping.

3. The method according to claim 1, wherein step (d) includes the step of applying a second binder to the embossed web for adhering said web to the creping surface.

4. The method according to claim 3, including applying said second binder to only one surface of the embossed web.

5. The method according to claim 1, wherein step (d) is performed by applying a second permanent binder to the embossed web for adhering said web to the creping surface, including the step of setting the second binder for aiding in maintaining the integrity of the nonwoven sheet.

6. The method according to claim 1, wherein step (d) is performed by applying a second temporary binder to the embossed web for adhering said web to a creping surface, including the step of breaking bonds formed by the temporary binder as said web is removed from the creping surface.

7. The method according to claim 1, wherein step (c) is performed by applying a permanent binder on opposed surfaces of the embossed web in a manner to form adhesive networks extending completely through the web in the densified areas.

* * * * *